United States Patent [19]

Friedman et al.

[11] Patent Number: 4,539,093

[45] Date of Patent: Sep. 3, 1985

[54] EXTRACTION PROCESS AND APPARATUS FOR HYDROCARBON CONTAINING ORES

[75] Inventors: Robert H. Friedman; Bertram E. Eakin, both of Houston, Tex.

[73] Assignee: Getty Oil Company, Houston, Tex.

[21] Appl. No.: 450,265

[22] Filed: Dec. 16, 1982

[51] Int. Cl.[3] ..... C10G 1/04

[52] U.S. Cl. ..... 208/8 LE; 208/11 LE; 208/8 R; 208/11 R

[58] Field of Search ..... 208/11 LE

[56] References Cited

U.S. PATENT DOCUMENTS

| | | | |
|---|---|---|---|
| 1,904,521 | 4/1933 | Pier et al. | 208/11 LE |
| 3,131,141 | 4/1964 | West | 208/11 LE |
| 3,488,278 | 1/1970 | Nelson | 208/8 LE |
| 3,553,099 | 10/1971 | Savage et al. | 208/11 LE |
| 3,875,046 | 4/1975 | Rosenbloom | 208/11 LE |
| 4,075,081 | 2/1978 | Gregoli | 208/11 R |
| 4,167,470 | 11/1979 | Karnofsky | 208/8 |
| 4,175,465 | 12/1979 | Murray et al. | 208/11 LE |
| 4,239,617 | 12/1980 | Karnofsky | 208/231 |
| 4,341,619 | 7/1982 | Poska | 208/11 LE |
| 4,347,118 | 8/1982 | Funk et al. | 208/11 LE |
| 4,389,300 | 6/1983 | Mitchell | 208/8 LE |

OTHER PUBLICATIONS

"Advances in Industrial Crystallization", 80 Chemical Engineering Progress 89, 93–94, (Mar. 1984).

J. H. Cottrell, "Development of an Anhydrous Process for Oil-Sand Extraction", published in M. A. Carrigy, ed., Athabasca Oil Sands: A Collection of Papers, Edmonton, Alberta: Research Council of Alberta, 1963.

R. Houlihan, "An Overview of Oil Sand Extraction--Commercial Technology and New Techniques", Contribution to UNITAR II Conference, Caracas, Venezuela, Feb., 1982.

*Primary Examiner*—D. E. Gantz
*Assistant Examiner*—Helane E. Maull
*Attorney, Agent, or Firm*—Arnold, White & Durkee

[57] ABSTRACT

There is provided a hydrocarbon extraction process and apparatus for removing hydrocarbons from a hydrocarbon containing ore such as a diatomite ore. The ore is preprocessed to the extent required to produce an extractable ore and subsequently mixed with a carrier to form an ore stream. The carrier may be a nonaqueous solvent and may further comprise a non-porous granular material such as sand. The ore stream is passed in substantially vertical countercurrent flow through a nonaqueous solvent to produce a product-solvent stream and a spent ore stream. The solvent is subsequently separated from the hydrocarbon stream, which may be further upgraded by removal of a heavy portion. This may be accomplished in the presence of a substantial amount of fines.

16 Claims, 4 Drawing Figures

EXTRACTION PROCESS AND APPARATUS FOR HYDROCARBON CONTAINING ORES

BACKGROUND OF THE INVENTION

There is provided an improved process and apparatus for extracting organic substances from a solid material and more particularly an improved process and apparatus for extracting hydrocarbons from hydrocarbon bearing ores such as diatomaceous earths and the like.

Many earth formations contain deposits having substantial amounts of hydrocarbons. Oil bearing diatomaceous earths, oil shale, bitumens, resins of fossil origin, tar sands and natural asphalts all contain varying degrees of hydrocarbons.

A variety of extraction processes for removal of oil from oil-bearing ores have been proposed. These may be roughly divided into the following categories: pyrolysis or coking; aqueous extraction and solvent extraction.

Illustrative of a process in the first category is the TOSCO process where mined crushed oil shale is preheated to about 500° F. and fed to a slanted, rotating drum, where it mixes with marble-sized ceramic balls preheated to 1600° F. The hot ceramic balls pulverize and heat the shale until oil and gas boil off. The spent shale is subsequently screened out and the oil vapors condensed and fractionated to provide naphtha, gas and oil.

Aqueous processes using steam or hot water have also been described. Exemplary of this category is a hot-water steam extraction process for oilsands consisting of the steps of conditioning, primary separation and air flotation. Hot water, steam and a base are used to form a pulp with the oilsand in the conditioning step. The effluent from the conditioning step is screened and additional water is added prior to passage to the primary separation step, where gravity allows solids to settle. Air flotation is used to remove bitumens which do not settle in the primary separation stage.

The literature discloses a number of solvent extraction processes, many of which employ water as well as a solvent. For example, U.S. Pat. Nos. 4,239,617 and 4,167,470 issued to Karnofsky describe a process which attempts to recover petroleum crude oil from oil laden diatomite by a continuous stagewise countercurrent extraction-decantation process. Ore is extracted by countercurrent decantation with a hydrocarbon solvent. Solvent is recovered from the extract by multiple effect evaporation followed by stripping. The spent diatomite is contacted with water and solvent is recovered from the resulting aqueous slurry of spent diatomite by steam stripping at superatmospheric pressure.

J. H. Cottrell, "Development of an Anhydrous Process for Oil-Sand Extraction", published in M. A. Carrigy, ed., Athabasca Oil Sands: A Collection of Papers, Edmonton, Alberta: Research Council of Alberta, 1963 (hereinafter referred to as the Cottrell article) discloses an anhydrous solvent extraction process using a three stage drain circuit to extract hydrocarbons from water-wet Athabasca oil sands. Process conditions are controlled to ensure that the inner film of water coating the sand particles and surrounded by a bitumen film is maintained in order to enhance the free flow of hydrocarbons through an oil sand bed. This was explained under the theory that the apparent diameters of the solid-water particles randomly laid down in the draining step were quite uniform and were larger than those of most dry solids existing within a given oil-sand sample.

In a commercial plant proposed in the Cottrell article oil sand and hydrocarbon solvent would be mixed in a mixer and then passed as a slurry on a moving belt through three consecutive drains. A mixture of solvent and hydrocarbon would pass through the slurried bed in each drain under appropriate process conditions to maintain the water film. Solvent would subsequently be recovered from the spent slurry by steam stripping and from the raw bitumen product recovered from the first drain by fractionation.

These and other prior processes suffer from one or more of several defects or limitations. For example, many prior processes fail to adequately mate process yields with process energy requirements. Other processes fail to make economical and efficient use of solvents, particularly in extracting the hydrocarbons from the hydrocarbon bearing ore. There are also problems involved in efficient recovery of any solvents used as well as reduced efficiencies due to the logistics and mechanics of removing large amounts of solids and problems associated with the presence of fines including fines removal from product streams. These and other defects or limitations are substantially minimized if not eliminated by the present inventive method and apparatus.

SUMMARY OF THE INVENTION

In accordance with the present invention there is generally provided a hydrocarbon extraction process and apparatus for removing hydrocarbons from a hydrocarbon containing ore such as oil bearing diatomaceous earths, oil shale, tar sands and the like. The ore is first processed to the extent required to produce an extractable ore. The processing step generally includes the crushing of the ore and may also include drying of the ore depending upon process materials and conditions. Drying of the ore may be beneficial, since subsequent separation of the nonaqueous solvent from the spent ore is facilitated by the prior removal of water. Extractable ore is then mixed with a carrier to form a flowable ore stream. A nonaqueous extracting solvent is then passed in substantially vertical countercurrent flow through the flowable ore stream to form a product-solvent stream made up of hydrocarbons and solvent and a portion of any fines and a spent ore stream made up of spent ore, solvent and the remaining portion of any fines. The extraction solvent is then separated from the product-solvent stream to form a hydrocarbon stream. A heavy portion is then separated from the hydrocarbon stream to form an upgraded hydrocarbon stream as a product.

The step of separating a heavy portion from the hydrocarbon stream may be accomplished by mixing the hydrocarbon stream with a secondary or upgrading solvent, such as a paraffinic hydrocarbon, in the presence of fines to produce a solvent-upgraded hydrocarbon stream and a heavy stream comprising substantially all of the fines, and the heavy portion from the hydrocarbon stream. After the secondary solvent has been separated, the fines and the heavy portion from the hydrocarbon stream may then be used as fuel for the process or as fuel for heating, such as in the cogeneration of steam and electricity.

When there are little or no fines, the step of separating the heavy portion from the hydrocarbon stream may be accomplished by cooling or reducing the pressure of the hydrocarbon stream sufficiently to separate the heavy portion. However, a secondary solvent may also be used. Where a secondary or upgrading solvent is employed it may comprise a paraffinic hydrocarbon and is preferably selected from those paraffinic hydrocarbons having from 3 to 7 carbons.

Substantially all of the primary solvent is preferably recovered from the spent ore stream and recycled. The recovery of the primary solvent is preferably accomplished by non-aqueous drying. After solvent recovery the spent ore may then be agglomerated with the use of silicates or the like to the extent necessary. If a granular non-porous material is employed, it is also preferably recovered from the spent ore stream and recycled.

The carrier which is mixed with the extractable ore to form a flowable ore stream is preferably similar to or identical with the nonaqueous extracting solvent which is passed in countercurrent flow through the ore stream to form a product-solvent stream. The carrier may also comprise a non-porous granular material such as sand. The use of a non-porous granular material may be appropriate where it is necessary or desirable to improve the permeability of the ore stream due to the presence of excessive amounts of fines. The use of a nonporous granular material may also allow greater velocities in the extracting zone, since it may increase the velocity or pressure required to fluidize the ore stream. A non-porous granular material may also be useful as a source of heat or to reduce the particulate content of the product-solvent stream depending upon the configuration of the various unit operations employed. For example, depending upon the type of ore being processed and other process conditions, where the overall process does not include the step of reducing the flow rate of the product-solvent stream prior to separating off the primary solvent, it may be preferable to use a non-porous granular material as a constituent of the carrier.

In a more detailed embodiment the ore is crushed and dried to produce an extractable ore. The extractable ore is then mixed with a nonaqueous extracting solvent to form a flowable ore stream. Additional nonaqueous extracting solvent is then passed in substantially vertical countercurrent flow through the flowable ore stream to form a product-solvent stream comprising hydrocarbons, solvent and a portion of any fines in the ore. A spent ore stream made up of spent ore, solvent and any remaining fines is also formed. The flow rate of the product-solvent stream is subsequently reduced to reduce the portion of any fines in the product-solvent stream. At least a substantial portion of the nonaqueous solvent is next separated off from the product-solvent stream to form a hydrocarbon stream. The hydrocarbon stream is then mixed with an upgrading solvent, such as a paraffinic solvent, in the presence of fines to form a solvent upgraded hydrocarbon stream and a heavy stream comprising substantially all of the fines and a heavy portion from the hydrocarbon stream.

There is also provided an improved apparatus for extracting hydrocarbons from a hydrocarbon containing ore. Generally there is provided a mixing zone for mixing an extractable ore and a carrier to produce a flowable ore stream. An extraction zone in fluid communication with the mixing zone and including a countercurrent flow zone is also provided for passing a solvent in countercurrent flow through the flowable ore stream to form a product-solvent stream of hydrocarbons and solvent as well as a spent ore stream of spent ore and solvent. A separating zone in fluid communication with the extraction zone is also provided for separating solvent from the product-solvent stream to form a hydrocarbon stream. There is further provided an upgrading zone in fluid communication with the separating zone for separating a heavy portion from the hydrocarbon stream to form an upgraded hydrocarbon stream.

The extraction zone may include a receiving zone in fluid communication with the mixing zone for receiving the flowable ore stream from the mixing zone. The outlet of the receiving zone is in fluid communication with the countercurrent flow zone. There may also be provided a reduced flow rate zone, the inlet of which is in fluid communication with the countercurrent flow zone.

In one embodiment the extraction zone includes a substantially vertical countercurrent flow zone having upper and lower portions. The vertical countercurrent flow zone has a substantially uniform cross-sectional flow area along its length. There is also provided a receiving zone located above the countercurrent flow zone. The receiving zone has an inlet and an outlet with the inlet being in fluid communication with the mixing zone and the outlet being in fluid communication with the upper portion of the countercurrent flow zone. The receiving zone has a cross-sectional flow area substantially similar to the cross-sectional flow area of the countercurrent flow zone. There is also provided a reduced flow rate zone having the shape of an annulus concentrically located with the receiving zone. The reduced flow rate zone has an inlet and an outlet with the inlet being in fluid communication with the upper portion of the countercurrent flow zone. The cross-sectional flow area of the reduced flow rate zone is larger than the cross-sectional flow area of the counter-current flow zone and may increase with the distance from the upper portion of the countercurrent flow zone.

There is also provided a solvent recovery zone for recovering primary solvent from the spent ore stream. Additionally, if a non-porous granular material is employed there is also provided a granular material recovery zone. The granular material recovery zone is connected to the extraction zone by a feeder having an inlet and an outlet. The outlet is connected to the granular material recovery zone. In one embodiment the outlet of the feeder is at a vertical level above the upper portion of the countercurrent flow zone. In another embodiment the feeder is self-sealing.

There follows a detailed description of a preferred embodiment of the present inventive apparatus and method in conjunction with the foregoing drawings. This description is to be taken by way of illustration rather than limitation.

DETAILED DESCRIPTION

Figure 1:
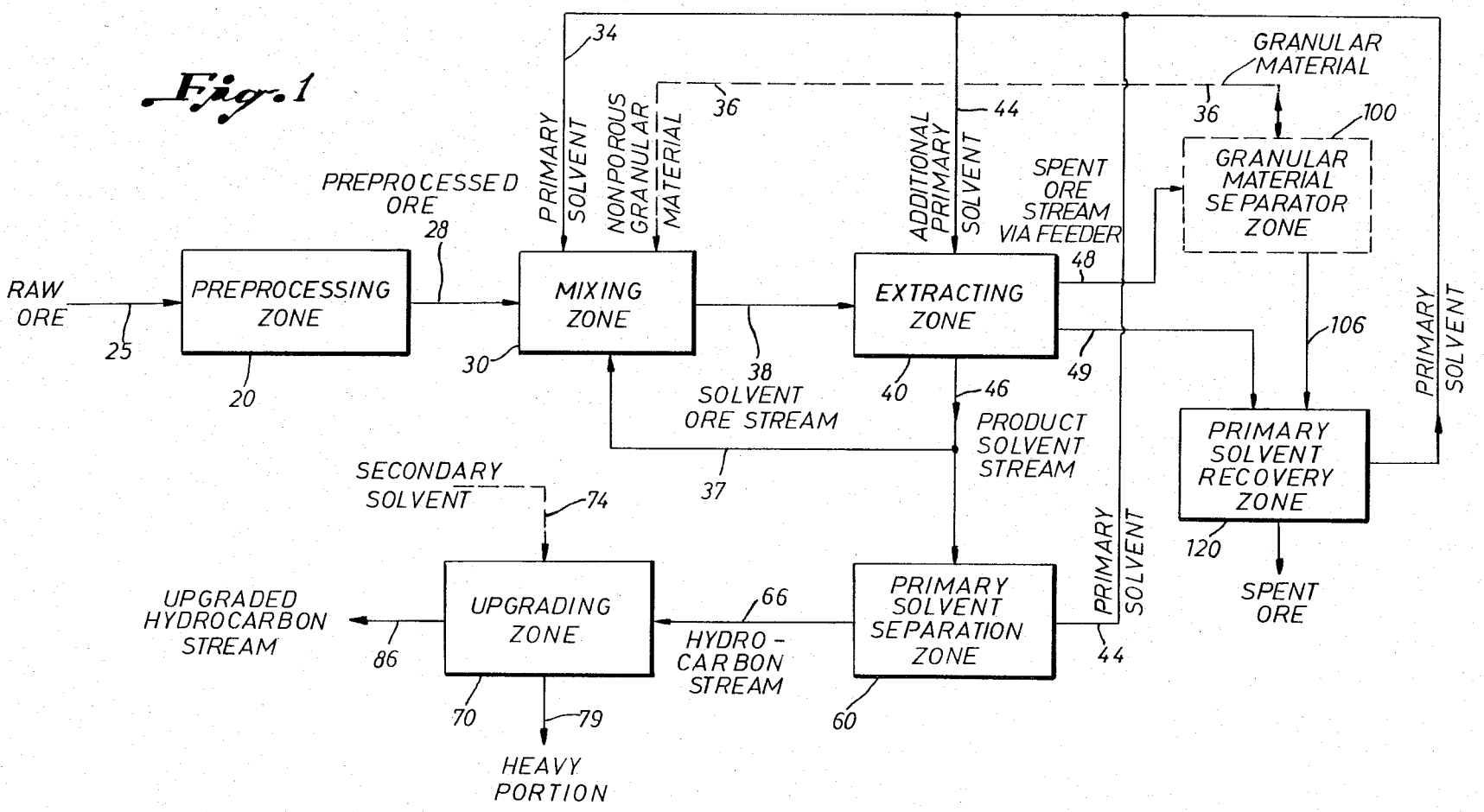
FIG. 1 is a flow chart depicting one embodiment of the present invention.

Referring generally to FIG. 1 there is shown a schematic outline of one embodiment of the present invention. Referring generally to that figure a raw ore is processed in a preprocessing zone 20. The processed ore is then passed via line 28 to a mixing zone 30 where it is mixed with primary or extracting solvent passing via line 34 or a product-solvent stream passing via line 37 or both. If the preprocessed ore does not have fines of a sufficient quantity or size to prevent substantially uniform countercurrent flow in an extracting zone or is not such as to materially reduce process efficiencies in view of the configuration of the unit operations used in the process, then it is not necessary to add a non-porous granular material along with the extracting solvent into mixing zone 30 as a carrier. However, if the processed ore contains a substantial amount of fines sufficient to prevent even countercurrent flow in the extracting zone, or if velocities obtainable without fluidization of the ore stream are too low or a very low velocity is desired, or if the configuration of the various unit operations so requires, a non-porous granular material may be passed via line 36 and mixed with the processed ore and the primary or extracting solvent in the mixing zone 30.

In either case a flowable ore stream is produced in the mixing zone 30 and passed via line 38 to an extracting or extraction zone 40 where additional primary solvent is passed in countercurrent flow through the ore stream to produce a product-solvent stream of hydrocarbons, primary solvent and a reduced portion of any fines as well as a spent ore stream made up of spent ore, solvent and any remaining fines.

The product-solvent stream along with any unremoved fines contained therein is then passed via line 46 to a primary solvent separation zone 60 where primary or extracting solvent is separated off for recycle via line 44 to the mixing zone 30 and the extraction zone 40.

A portion of the product-solvent stream may be recycled to the mixing zone 30 via line 37. Recycle of a portion of the product-solvent stream will apparently reduce the efficiency of the extraction process which begins to occur in the mixing zone 30. However, it is believed that this loss of efficiency is more than made up for in the primary solvent separation zone 60, since recycle of a portion of the product-solvent stream materially reduces the heating load in the primary solvent separation zone 60.

As indicated the primary or extracting solvent is separated from the product-solvent stream passing through the primary separation zone 60. The resulting hydrocarbon stream is then passed via line 66 from the primary solvent separation zone 60 to an upgrading zone 70, where a heavy portion of the hydrocarbon stream is separated to produce an upgraded hydrocarbon stream in line 86. Where the hydrocarbon stream contains little or no fines, the heavy portion may be separated by means of temperature or pressure differentials. However, if the hydrocarbon stream contains a substantial amount of fines, then a secondary or upgrading solvent should be passed via line 74 and employed in the upgrading zone 70 to precipitate out the heavy portion of the hydrocarbons along with the fines. A secondary or upgrading solvent may also be employed even though the hydrocarbon stream contains little or no fines. The heavy portion may be recycled via line 79 from upgrading zone 70 for use as fuel in the generation of process heat and, possibly the cogeneration of electricity.

The spent ore stream may be passed via line 48 to a granular material separator zone 100 if a non-porous granular material is used. Line 48 may comprise a feeder or elevator which may be self-sealing. The separated granular material is recycled via line 36 to the mixing zone 30 and the spent ore stream absent the granular material is forwarded via line 106 to the primary solvent recovery zone 120, where primary solvent is recovered for selective recycle to the mixing zone 30 and extraction zone 40. The spent ore is then disposed of. If no granular material from the mixing zone 30 is employed, then the spent ore stream may pass directly to the primary solvent recovery zone 120 via line 49.

Figure 2:
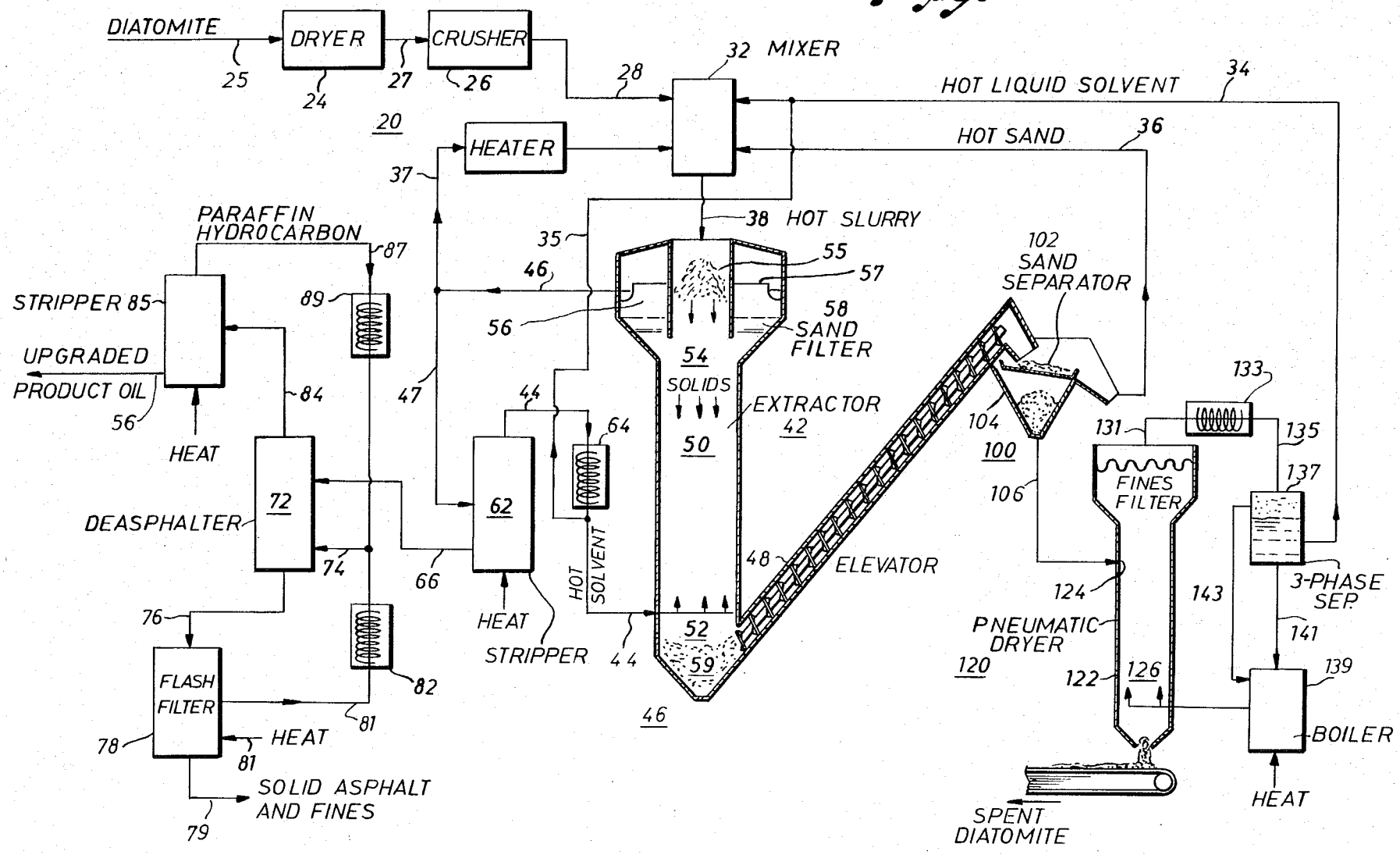
FIG. 2 is a schematic view of one embodiment of the present invention.
Figure 3:
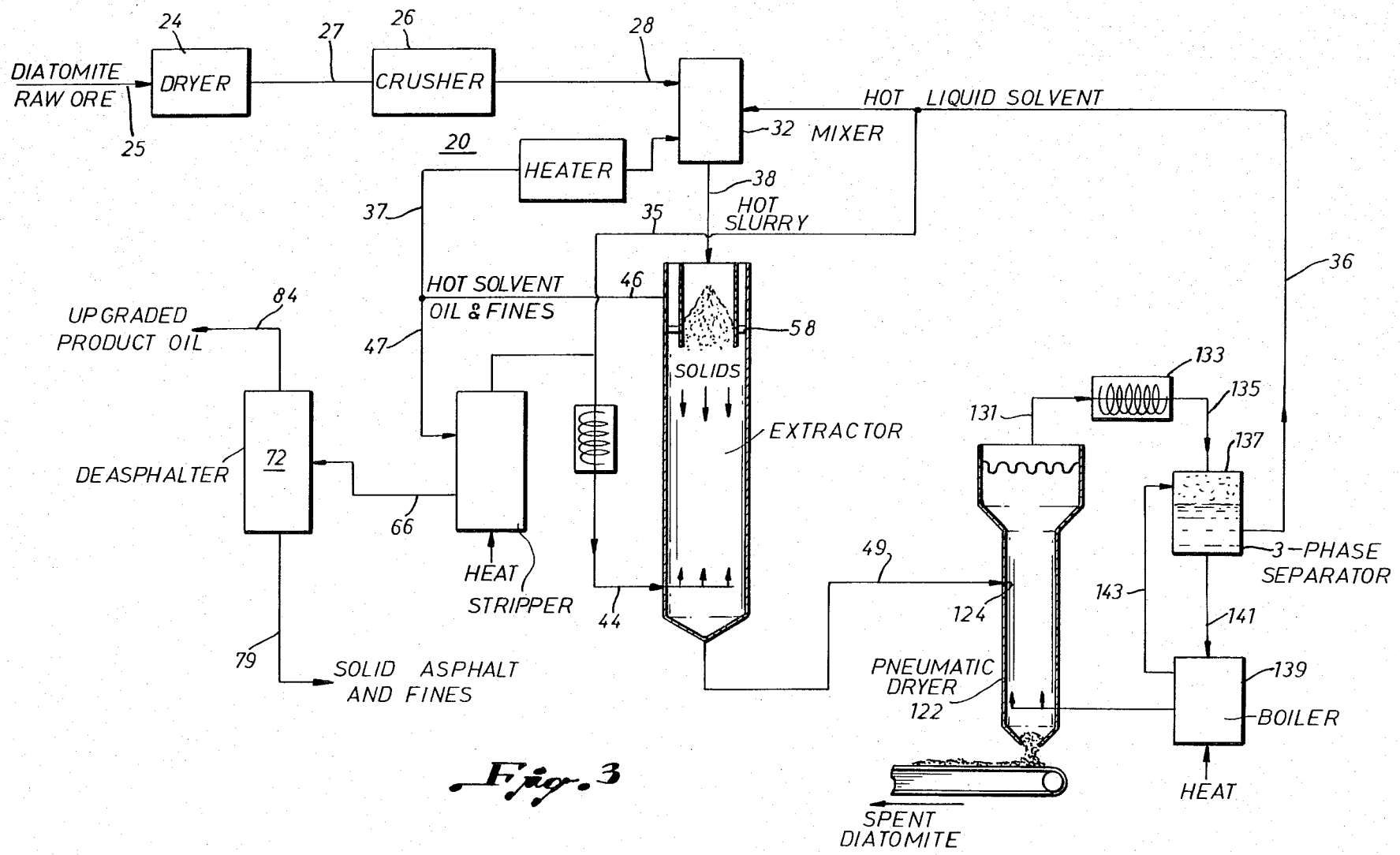
FIG. 3 is a schematic view of another embodiment of the present invention.

Referring more particularly to FIGS. 2 and 3, each zone will now be described in more detail.

Preprocessing Zone

The raw ore may generally be any solid material with extractable organic material contained therein. Examples include bitumen, oil bearing diatomaceous earth, oil shale, tar sands, resins of fossil origin, natural asphalt and the like. It is believed preferable to use a raw ore which is recently mined, since initial experiments indicate that partially oxidized hydrocarbons will generally dissolve more slowly than un-oxidized hydrocarbons.

The ore should be processed so as to provide an extractable ore for the process. The processing requirements will be dictated by overall process conditions and streams employed including the choice of solvents, the amount of fines produced, and the use or nonuse of a non-porous granular material. For example, where the ore has a significant free water content, it is preferable that the raw ore be dried to remove the free water, particularly where fines are produced, since the fines and water tend to form an emulsion or suspension. For example, if the raw ore is a diatomite ore, it is preferably dried since it will generally contain approximately 30 to 35 percent by weight water and have a substantial amount of free water. This water would otherwise tend to combine with the fines and solvent or oil to produce an emulsion, thus complicating solvent recovery.

The ore should also be generally reduced in size to promote solvent contact with the hydrocarbons contained in the ore. The exact size reduction will vary according to process conditions including the type of solvent employed as would be known to one skilled in the art having the benefit of this disclosure. For example, shale may be reduced to generally pebble size or smaller. If diatomite ore is to be employed as the raw ore it may be crushed to pieces having a diameter of approximately 1.5 inches (3.8 cm) or less.

The percentage of raw ore which is reduced to fines may vary over a wide range without impairing the efficiency of the present process. This is particularly so where a non-porous granular material or a reduced flow rate zone or both are employed or where a secondary solvent is used in conjunction with any fines to separate off a heavy portion from the final product or upgraded hydrocarbon stream, all as shall be more fully described below.

As shown in FIGS. 2 and 3 the preprocessing zone 20 may be comprised of a dryer 24 and a crusher 26. A raw diatomite ore may be passed via line 25 to dryer 24 where the diatomite ore is dried. The dried diatomite ore is then passed via line 27 to the crusher 26 where the dried diatomite ore is reduced in size. The processed ore is then passed via line 28 to mixer 32 of mixing zone 30. The dryer 24 and the crusher 26 may be of conventional construction as would be known to one skilled in the art having the benefit of this disclosure.

Mixing Zone

The processed ore is mixed in mixing zone 30 with a primary or extracting solvent. A wide variety of solvents may be employed as primary solvents. Generally, the extracting solvent may be anything that will dissolve the hydrocarbons contained in the processed ore under the process conditions in the extracting zone. The solvent should preferably be relatively easy to recover from the spent ore. To this end, the extracting solvent is nonaqueous.

As hydrocarbon ores generally contain a wide range of hydrocarbons, it is believed that the solvent may have a relatively broad number of constituents with a wide range of molecular weights and characteristics. It is further believed that the molecular structure of the solvent should be preferably reasonably close to the material to be extracted from the ore and have a substantial aromatic portion. For example, a refinery or other process stream may be employed as a source of solvent. An appropriate additive or additives may be provided to adjust the characteristics of the primary solvent if desired. For example, if a solvent stream has a low asphalt solubility relative to the asphaltic hydrocarbons in the ore, then an aromatic hydrocarbon might be added to the solvent to improve its compatibility with the hydrocarbons, depending upon what effects this would have upon other portions of the process, such as removal of the solvent from the spent ore.

By way of example, where oil is being extracted from a diatomaceous earth, a stream which is high in xylenes and contains some heavier aromatics with little or no toluene or lighter constituents may be used as a solvent since it efficiently extracts oil from the diatomite ore, yet is believed to be relatively easy to separate from the spent diatomite ore.

The temperature of the solvent entering the mixing zone 30 is preferably such that in conjunction with other feed streams the operating temperature in the extraction zone 40 will be preferably in the range of about 140° to 200° F. (60° to 93° C.) and most preferably about 185° to 200° F. (85° to 93° C.).

If the processed ore contains a substantial portion of fines sufficient to prevent countercurrent extraction or if the configuration of process unit operations so requires, then a non-porous granular material may generally be added to the mixing zone 30 in order to promote proper extraction of the hydrocarbons in the extracting zone 40. A wide variety of granular materials which have little or no affinity for hydrocarbons under the process conditions in the extracting zone may be employed. The granular material should also be of sufficient size to materially increase the permeability of the ore fines to the solvent. For example, the non-porous granular material may be sand or small beads or the like.

The amount of sand or other non-porous granular material passing via line 36 into mixing zone 30 may vary depending on various process conditions. However, the amount of sand or other non-porous granular material should be sufficient to materially increase the permeability of the preprocessed ore to the primary solvent, reduce the quantity of solvent required to make a flowable slurry, allow greater velocities in the ore stream or some combination thereof. By way of example, the ratio of ore to sand might be 1:1 by weight. One may also take advantage of the efficiencies provided by solid-solid heat exchange and use the granular material to provide additional heat required to raise the flowable ore stream to the proper temperature for extraction of the hydrocarbons in the extracting zone.

The presence of the granular material permits a wider range of flow rates without fluidizing the ore, thus further contributing to process efficiency and allowing ore of widely varying hydrocarbon content to be extracted. When the velocity of the solvent is sufficient to fluidize the ore, the ore tends to release the finest particles into the hydrocarbon-solvent mixture thus resulting in excessive amounts of fines entering any unit operations downstream of the extracting zone.

Some ores may require the addition of a granular material to form a flowable ore stream when mixed with a solvent. Other ores may not generally require the addition of a granular material under similar process conditions due to the make-up of any fines contained in the ore and the configuration of one or more of the various unit operations as described herein. However, a granular material may be used to advantage, since granular material may reduce the amount of solvent necessary to move spent ore leaving the extracting zone or allow greater variation in relative solvent flow rates while further limiting the amount of ore particles in the solvent-hydrocarbon stream leaving the extracting zone.

As shown in FIG. 2, if non-porous granular material is to be used, then the processed ore from line 28 is mixed with hot solvent from line 34, oil and solvent from line 37 and hot sand from line 36 to produce an ore stream such as a slurry, passing through line 38 to extraction zone 40. Alternately, as shown in FIG. 3, if an ore, such as oil shale or a diatomaceous earth, contains an insubstantial portion of fines or will otherwise flow uniformly in the extracting zone under process conditions, then the preprocessed ore from line 28 need only be mixed with solvent passing via line 34 in order to produce a flowable ore stream such as a slurry passing through line 38 to extraction zone 40.

Extracting Zone

The extracting zone 40 may have a variety of configurations. However, it must generally allow solvent passing via line 44 to pass in substantially even or uniform countercurrent flow through the ore stream as it passes through the extracting zone 40 to form a product-solvent stream of hydrocarbons and solvent as well as a portion of any fines in line 46, and a spent ore stream comprising spent ore, primary solvent and any remaining fines for passage to feeder or elevator 48 as shown in FIG. 2 or line 49 as shown in FIG. 3. The flow is countercurrent in order to allow efficient separation of the solvent from the spent ore and facilitate solvent extraction of the hydrocarbons from the ore. The flow is substantially even or uniform and substantially unfluidized in order to further facilitate extraction of the hydrocarbons, since the presence of nonuniform patterns of flow will result in reduced efficiency since the oil concentration of the solvent and ore will not vary in a substantially uniform fashion along the length of the extracting zone and may lead to the creation of pockets of ore not contacted by an appreciable amount of solvent.

In one embodiment the extracting zone is made up of a countercurrent flow zone, a receiving zone and a reduced flow rate zone. The countercurrent flow zone is a substantially vertical countercurrent zone having upper and lower portions and a substantially uniform cross-sectional flow area along its length. The receiving zone is located above the countercurrent flow zone and has an inlet and an outlet. The outlet of the receiving zone is in fluid communication with the upper portion of the countercurrent flow zone and has a cross-sectional flow area substantially similar to the cross-sectional flow area of the countercurrent flow zone. The reduced flow rate zone is made up of an annulus concentrically located with the receiving zone. The reduced flow rate zone has an inlet and an outlet with the inlet being in fluid communication with the upper portion of the countercurrent flow zone. The cross-sectional flow area of the reduced flow rate zone is about at least as large as and preferably larger than the cross-sectional flow area of the countercurrent flow zone.

The extraction zone may also include a cocurrent flow zone indicated generally at 59. In this zone the ore and solvent are in cocurrent flow prior to leaving the extraction zone.

As illustrated in FIG. 2 in one embodiment for use with an ore having a substantial amount of fines the substantially vertical countercurrent flow zone is housed in a vertical hollow cylinder 50 and begins at a point of hot solvent injection indicated by nozzles 52 and ends in an upper portion indicated generally at 54. The receiving zone is made up of downcomer 55 which preferably has a diameter substantially similar to that of the countercurrent flow zone 50 in order to provide uniform downward flow of solids. The reduced flow rate zone is comprised of an annulus shown generally at 56 and equipped with a circumferential weir 57 which is located within the annulus 56 to provide an overflow for passage of primary solvent, hydrocarbons and a selected portion of fines into line 46. As shown in FIG. 2 the cross-sectional flow area of the reduced flow rate zone initially increases in diameter as the distance from the upper portion of the countercurrent flow zone increases. Whether or not a non-porous granular material is added in the mixing zone, a layer of a non-porous granular material may be located within the reduced flow rate zone as indicated at 58 to facilitate the removal of any fines. Other filters may be employed to advantage, particularly where a non-porous granular material is not used.

In operation a hot slurry passing via line 38 enters downcomer 55. The solids generally move downward through the extractor toward the cocurrent flow zone 59, while liquid flow of the hot solvent is generally upward and countercurrent of the solids above the point of solvent injection 52. As the primary or extracting solvent is allowed to permeate the solids and move upwardly therethrough, it becomes more and more saturated with the hydrocarbons until it reaches the upper portion of the countercurrent extraction zone. As the entering hot slurry rises to an equilibrium level in the downcomer, the flow of the solvent is diverted to the reduced flow rate zone, which facilitates the settling of any fines contained in the solvent and hydrocarbons. The granular material or other filter 58 further aids in the removal of any fines from the solvent-hydrocarbon mixture. The resulting hot mixture of solvent, hydrocarbons and any remaining fines then overflows the circumferential weir 57 and flows into line 46.

The design of the reduced flow rate zone in the extractor 42 provides for the removal of fines through both settling and filtration. Due to the design of the reduced flow rate zone the solvent-hydrocarbon mixture which is moving upwardly through the reduced flow rate zone first enters a stationary bed of ore located just below the filters 58. The ore, which is generally the best filter for the fines since the fines are derived from the ore, acts as a filter along with the stationary filters 58. Additionally, since the bed of ore in the lower portion of the reduced flow rate zone is not moving, the upward velocity of the solvent-hydrocarbon solution is immediately less in relation to the countercurrent flowing solids passing through the countercurrent flow zone. As the solvent-hydrocarbon mixture continues to rise through the reduced flow rate zone its upward fluid velocity continues to decrease as the diameter of the reduced flow rate zone continues to increase. Thus, the presence of the stationary ore and the filters 58 serve to filter fines out of the solvent oil mixture, while the lack of movement of the stationary ore in the filters as compared to the countercurrent flow of the solids through the countercurrent flow zone and the expanding cross-sectional area of the reduced flow rate zone serve to encourage settlement of the fines due to the reduced relative velocity of the solvent oil mixture.

A substantial portion of the fines are thus collected in the filters 58, by the stationary ore bed below those filters and in the solids passing in countercurrent flow toward the lower portion of the countercurrent flow zone. Additionally, any fines settling out of the primary solvent-hydrocarbon mixture above the filters are caught in the filters.

As spent ore is constantly being withdrawn from the bottom of the extractor 42 via feeder or elevator 48, if the flow of hot slurry via line 38 stops, the moving solids feed level drops below the bottom of the downcomer such that the stationary ore bed below the filters and material within the filters flows downwardly with the moving ore. As soon as any material from the filters and the accumulated fines have entered the countercurrent flow portion of the extractor, the slurry feed may be restarted, while momentarily stopping withdrawal from the bottom of the extractor until equilibrium conditions are again reached. A fresh layer of material may then be added to the filters 58, if appropriate.

A number of variations or changes can be made to the extractor 42 as shown in FIG. 2 to further facilitate the removal of fines or otherwise increase the permeability of the solid stream flowing downwardly through the countercurrent zone. For example, one or more chemical additives may be injected above the filters 58 to assist in flocculation and precipitation of the fines. Additionally, the configuration of the reduced flow rate zone may be varied to accommodate a wide variety of velocity changes. For example, the upper portion of the outer walls of the annulus 56 may slope outwardly, the slope of the outer walls may be varied or both.

Variations in size and capacity of the extractor may also be made as would be known to one skilled in the art having the benefit of this disclosure. For example, the height may be varied depending upon the number and height of "theoretical equivalent plates" necessary to effect the desired degree of extraction under a given range of process conditions. However, the cross-sectional flow area must be sufficient to permit solids and liquids to flow countercurrently. Also, in the presence of fines the configuration of the reduced flow rate zone is preferably such as to reduce the linear flow rate and hence the amount of fines which pass into the product-solvent stream.

Where the ore stream passing via line 38 is comprised of an ore having an insufficient amount of fines to cause substantially uneven or nonuniform flow, or is of such a composition as to not otherwise impair the efficiency of the process, then the reduced flow rate zone of extractor 42 may be eliminated, as indicated generally in FIG. 3 and as would be known to one skilled in the art having the benefit of this disclosure.

Primary Solvent Separation

The product-solvent stream leaving via line 46 may all pass via line 47 to the primary solvent separation zone 60 where the primary or extracting solvent is separated off for recycle back to the mixing zone 30 or the extracting zone 40. The resulting hydrocarbon stream is passed to the upgrading zone 70. Alternately, a portion of the product-solvent stream may be recycled via line 37 to the mixing zone 30. Although this reduces the efficiency of the extraction process occurring in the mixing zone, recycle of a portion of the product-solvent stream reduces the process requirements in the primary separation zone 60 and allows recycle of the solvent from primary solvent recovery zone 120 directly to the mixing zone via lines 34, 35 and 44. This in turn results in an improved efficiency for the overall process without any reduction in yield as will be indirectly illustrated by example two.

As indicated in FIGS. 2 and 3, the primary solvent separation zone 60 may comprise a stripper 62. For example, it may be a stripper having a packed column with a steam heated section at the bottom. Hot solvent vapor from the top of the stripper then passes via line 44 through cooling coils 64 prior to reinjection into the countercurrent flow zone of extracting zone 40. A hydrocarbon stream made up of hydrocarbons and any fines passes from the bottom of the column via line 66 to the upgrading zone 70.

Where a material portion of fines are carried over to the stripper 62, the stripper should not be a plate column, since any fines carried over would eventually fill the plates. Rather a packed or other appropriate column should be used.

Upgrading Zone

A heavy portion is separated from the hydrocarbon stream in the upgrading zone to produce an upgraded hydrocarbon stream. For example, an asphalt fraction can be removed from the hydrocarbon stream to produce an upgraded product oil. To accomplish this end the unit operations within the upgrading zone may be varied depending upon process conditions as illustrated below.

In accordance with one feature of the present invention a heavy portion may be separated off by mixing the hydrocarbon stream with a secondary or upgrading solvent in the presence of fines to produce a secondary solvent-upgraded hydrocarbon stream and a heavy stream comprising the fines, secondary solvent and the heavy portion from the hydrocarbon stream. The secondary solvent is then separated from the secondary solvent-upgraded hydrocarbon stream for recycle in the upgrading zone and an upgraded hydrocarbon stream is produced. The secondary solvent is likewise separated from the heavy stream for recycle within the upgrading zone.

Referring now to FIG. 2, in accordance with this aspect of the invention hot crude oil and fines could be fed via line 66 into deasphalter 72 and contacted therein by an upgrading solvent such as a paraffinic hydrocarbon entering the deasphalter via line 74. The concentration of the crude oil or hydrocarbon stream in the paraffinic liquid is controlled such that asphalt precipitates out in a generally crystalline form. By selection of the particular solvent, the ratio of the hydrocarbon stream to solvent and proper selection of process conditions such as operating temperatures, the amount of asphaltic material precipitated out can be controlled.

The precipitated heavy portion such as asphalt is carried out of the bottom of the deasphalter 72 as a suspension in the secondary solvent via line 76 to a flash filter 78. The flash filter separates the secondary solvent from the heavy portion and fines, which pass via line 79 for use as fuel for the process or in the cogeneration of heat or electricity or as otherwise appropriate. The secondary solvent is recovered from the flash filter 78 and is recycled via line 81 after cooling by heat exchanger or other appropriate mechanism or process 82 to line 74 and hence the deasphalter 72. By way of example, the flash filter may be a heated low pressure rotary filter, which recovers a portion of the secondary solvent as a liquid. The deasphalter 72 may essentially be an empty cylindrical container.

The hydrocarbon-secondary solvent mixture passing from the top of the deasphalter 72 is fed via line 84 to a stripper 85 where the secondary solvent is separated off from the upgraded hydrocarbon product.

The upgraded hydrocarbon product passes via line 86 as the primary product of the process, while the secondary solvent is recycled via line 87 to line 74 and hence the deasphalter 72. The secondary solvent recycling in line 87 may be cooled to condense any vapor prior to recycling of the secondary solvent to the deasphalter 72. The upgraded oil product in line 86 has a reduced asphaltenes content with a reduced density and viscosity as compared to the hydrocarbon content of the hydrocarbon stream in line 66.

In an alternate embodiment where the ore contains an insignificant portion of fines or the fines have otherwise been removed from the hydrocarbon stream in line 66 through the use of a filter or other method, the step of separating off the heavy portion may be beneficially accomplished by changes in temperature or pressure or both to precipitate or separate out the heavy portion without the use of a secondary solvent. For example, as indicated in FIG. 3 the hydrocarbon stream could pass via line 66 to a deasphalter 72 where appropriate changes in temperature or pressure or both could separate out the heavier asphalt portion from the remainder of the stream with the upgraded product then passing via line 84 and the heavy portion, such as the asphalt, passing via line 79 for use in the cogeneration of electricity or heat or to meet other process needs. Unlike the embodiment shown in FIG. 2, any resulting asphalt may be generally amorphous rather than crystalline.

Spent Ore Feeder

As a flowable ore stream is being passed through the extracting zone, the process may be operated in a continuous fashion, since the spent ore stream formed in cocurrent zone 59 may be continuously removed by use of feeder or elevator 48 as shown in FIG. 2 or line 49 as shown in FIG. 3. Thus, upon leaving the extracting zone 40 the spent ore stream may pass via feeder or elevator 48 or line 49 to further processing whereby all or some portion of the primary solvent and any nonporous granular solid material is recovered prior to disposal of the spent ore including fines.

The elevator or feeder 48 may take on any of a variety of configurations depending upon process conditions. For example, the spent ore recovery zone may be connected to the extracting zone 40 by a feeder having an inlet and an outlet, the outlet of the feeder being at a vertical level above the liquid level in the extracting zone 40. This hydrostatically, ensures that solvent flow is minimized in the cocurrent zone 59 of the extracting zone 40. In such a case the feeder or elevator 48 may be any one of a variety of solid conveyors such as a screw type auger or a segmented belt.

No provision need be made for the flow of excessive amounts of solvent through the elevator 48 as long as the outlet of the elevator 48 is higher than the liquid level in the extracting zone 40 such as that established by weir 57. Of course, the height of the outlet may be varied depending upon other process conditions such as pressure and the amount of solvent to be carried over. Alternately, the feeder may be self-sealing. For example, it may be a self-sealing screw type auger having screws of varying pitch. However, it is generally preferable to avoid having the liquid flowing from the countercurrent zone and down into the cocurrent zone faster than the solids. It is also preferable to minimize the amount of solvent in the cocurrent zone in order to reduce the load in the primary solvent recovery zone 120.

Granular Material Separator Zone

If a non-porous granular material is used, the granular material separator zone 100 may comprise any one of a variety of conventional apparatus or devices to separate off the granular material from the spent ore as would be known to one skilled in the art having the benefit of this disclosure. As shown in FIG. 2 the separator zone 100 comprises a separator 102. For example, where sand is employed as the granular material and a diatomite ore is being processed, a shale shaker may be employed for separator 102 to separate out the sand from the spent diatomite ore and the extraction solvent as well as any fines. Alternately, a hydrocyclone might be employed, though this may not always be preferred since excess liquid may be required.

Primary Solvent Recovery Zone

Once any granular material has been separated from the spent ore and solvent as well as any fines in the separator zone, the spent ore passes via line 106 to the primary solvent recovery zone 120. For example, as shown in FIG. 2 where a separator such as a shale shaker is used, the spent ore-solvent-fines mixture may be collected in a funneling device 104 and pass via line 106 to the primary solvent recovery zone 120.

The primary solvent recovery zone 120 may comprise any of a variety of unit operations which would separate off the primary solvent and any fines from the spent ore. For example, as shown in FIG. 2 the solvent, ore and fines may pass via line 106 to pneumatic dryer 122. The pneumatic dryer 122 is essentially a long, vertical duct or tube with a device, such as nozzles indicated by 124, for dispersing wet solid into hot condensable gases or vapors in order to evaporate the solvent from the spent ore. The hot vaporized liquid enters near the bottom of the duct or tube and flows in an upward direction. Solvent-spent ore enters near the top of the dryer such that the solids flow down, the vapors flow upward and solvent is evaporated from the spent ore.

By way of example, super heated steam could be used as the hot vapor to both provide heat and to utilize the partial pressure effect known as "steam stripping". The larger spent ore particles would fall directly through the rising steam passing from nozzles 126 located in the lower portion of the pneumatic dryer 122. Smaller particles of the spent ore along with any fines would move upward with the steam and would be removed in a collector or filter 128 located in or near the upper regions of the pneumatic dryer 122. The collector could comprise a bag filter or a cyclone as well as a variety of other unit operations. Additionally, wet scrubbing with sodium silicate solution may be utilized to recover the finer solids.

The resulting steam-solvent-vapor mixture passes via line 131 to partial condenser 133 where the vapor mixture is partially condensed. Partially condensed vapor mixture then passes via line 135 to a three-phase separator 137, where the solvent is removed as a hot liquid stream as the middle phase and recycled via line 34 to the mixer 32. The bottom phase comprising condensed water is recycled to the boiler 139 via line 141 while the top phase comprising uncondensed steam is recycled to the boiler 139 via line 143.

As shown in FIG. 3 much the same unit operations could be used for the primary solvent recovery zone 120 where a granular material separator zone is not required. For example, a solvent-spent ore mixture could be passed via line 49 to the primary solvent recovery zone 120 which could be set up essentially as before with the possible exception of the collector 128 which may be reduced in capacity or eliminated depending upon the fines content and the characteristics of the spent ore.

Unit operations of varying types and configurations may be employed in conjunction with each other in setting up the primary solvent recovery zone 120. For example, where a pneumatic dryer is used the heating required to evaporate the solvent will depend upon the relative gas-solids flow rates. Additionally, the dryer diameter will be a function of upward gas velocity which in turn is a function of the flow dynamics of the spent ore and a proportion of total solids to be removed by the collector, such as bag filters, all as would be known to one skilled in the art having the benefit of this disclosure. A two-phase separator could be substituted for the three-phase separator 137 depending upon process conditions. However, the dryer is preferably nonaqueous in the sense that liquid water is not used directly to remove the solvent, since such use would complicate recovery of the solvent by forming an emulsion with the solvent and any fines.

A variety of variations of the foregoing unit operations and various zones may be accomplished. For example, it may be possible to use a more volatile primary solvent where a pressurized extraction vessel is employed in the extracting zone 40. Additionally, the reduced flow rate zone in the extracting zone maybe varied in capacity depending upon the configuration of the upgrading zone; the use of filters downstream of the extracting zone or both.

The following examples are provided by way of illustration rather than limitation.

EXAMPLE 1

Several tests were run to determine the most appropriate solvent. Oil was extracted from a diatomite ore with several solvents, including n-heptane, toluene and several aromatic refinery streams taken from a toluene column. The make-up of the aromatic refinery streams is shown in Table 1.

TABLE 1

PROPERTIES OF AROMATIC REFINERY STREAMS

| Tests | Refinery Stream: Toluene | Feed to Toluene Column | Toluene Column Bottoms | Aromatics 150 |
|---|---|---|---|---|
| Gravity, °API | 30.9 | 31.0 | 31.2 | 25.9 |
| Sp. Gravity | 0.871 | 0.871 | 0.870 | 0.899 |
| Distillation: | °F. | °F. | °F. | °F. |
| Initial Boiling Point | 230.0 | 238.3 | 279.7 | 382 |
| 5% | 230.5 | 239.7 | 280.2 | 386 |
| 10% | 230.5 | 240.4 | 280.4 | 388 |
| 50% | 230.9 | 245.5 | 281.7 | 392 |
| 90% | 231.0 | 266.5 | 283.1 | 402 |
| 95% | 231.1 | 276.4 | 284.2 | 406 |
| Final Boiling Point | 231.3 | 282.6 | 286.5 | 416 |
| Flash Point (°F.) | 48 | 32 | 32 | 160 |
| GLC Analysis: | | | | |
| Non-Aromatics | 0.01 | * | — | — |
| Benzene | 0.10 | 0.04 | — | — |
| Xylenes | * | 31.2 | — | — |
| Aromatics, by ASTM D1319 | — | — | 100 | 96% |

*Not detected.

The following experimental procedure was adopted. A four-foot length of 0.5-inch (1.27 cm) outside diameter tubing was packed with raw diatomite and mounted in an oven. To help attain uniform packing and reproducible laboratory results, the raw diatomite was dried for 30 minutes under vacuum, and any particles which would not pass through a No. 40 sieve were discarded. A Ruska volumetric pump injected solvent into the bottom of the tube at 16 to 24 cc/hr. Twenty feet of ⅛-inch outside diameter clear nylon tubing was attached to the top of the diatomite tube. This permitted the initial 15 cc's of solvent-oil mixture to be easily sampled. When the tube was full, it was removed and a short tube attached which led outside the oven. Successive 5 to 10 cc samples were collected until clear solvent was produced. At the end of the run, the coil with the initial fluid was cut into short lengths, and the oil-solvent mixture in each length displaced into weighed beakers.

In an attempt to provide a constant end-point for each test, regardless of variation in the initial oil saturation in the raw diatomite, the solvent was then displaced with a very powerful solvent, tetrahydorfuran (THF). Samples of the produced THF-oil mixture were collected until clear or substantially clear THF was produced.

The solvent in the collected samples was evaporated overnight under a hood, and then for 30 minutes in a vacuum oven at 120° F. The less volatile solvent samples were recycled through the vacuum oven until they reached a constant weight. The density was measured for the combined oil samples from one run.

Various runs were conducted with two master composite samples (MCS No. 1 and MCS No. 2, the latter of which is more finely ground) and a core material (core) taken from 501 to 510 feet in a core hole. The two MCS samples had been exposed to air for some time, as compared to the core material. The results are given in Table 2.

TABLE 2

SUMMARY OF AROMATIC SOLVENT EXTRACTIONS

| Solvent / Ore | n-Heptane MCS #1 | Toluene MCS #2 | A-150 MCS #2 | n-Heptane MCS #2 | TCB* MCS #2 | TCF* MCS #2 | n-Heptane Core | Toluene Core |
|---|---|---|---|---|---|---|---|---|
| Oil, wt % | 16.2 | 20.9 | 21.8 | 17.3 | 22.8 | 22.5 | 16.8 | 20.0 |
| Add'l with THF, wt % | 7.0 | 3.6 | 3.0 | 6.2 | 1.7 | 1.7 | 6.5 | 3.9 |
| Total, wt % | 23.2 | 24.5 | 24.8 | 23.5 | 24.4 | 24.2 | 23.2 | 23.9 |
| Oil Recovered by Solvent: | | | | | | | | |
| % of Total | 69.9 | 85.0 | 88.0 | 73.6 | 93.1 | 93.0 | 72.1 | 83.7 |
| Gravity, °API | 16.5 | 12.4 | 11.1 | 14.4 | 10.9 | 11.4 | — | — |

*TCB is Toluene Column Bottoms; TCF is Toluene Column Feed.

The concentration of oil in solvent in each of the first four samples for each run is given in Table 3. In addition, the weight percent of the total oil recovered by each solvent that was contained in these first four samples is also given.

TABLE 3

OIL CONCENTRATION AND RECOVERY

| Solvent Sample | n-Heptane | Toluene | A-150 | TCB* | TCF* | n-Heptane | Toluene |
|---|---|---|---|---|---|---|---|
| | wt % oil in the solvent-oil mixture | | | | | | |
| 1 | 72.7 | 80.3 | 94.3 | 84.0 | 65.6 | 71.5 | 97.2 |
| 2 | 66.5 | 75.0 | 73.7 | 81.2 | 62.8 | 66.3 | 87.9 |
| 3 | 50.8 | 61.2 | 56.3 | 76.6 | 58.1 | 61.5 | 75.4 |
| 4 | 42.5 | 51.7 | 43.4 | 62.2 | 48.9 | 47.6 | 45.6 |
| Fraction of Oil, %** | 72.9 | 56.5 | 59.7 | 71.4 | 55.0 | 80.4 | 82.4 |

*TCB is Toluene Column Bottoms; TCF is Toluene Column Feed.
**This is the weight of oil produced in the first four samples divided by the weight of the total oil recovered.

The results of these and other tests indicate that aromatic refinery streams will recover more oil from a diatomite ore than many single solvents such as heptane. More particularly, the foregoing indicates that the aromatic stream marked Toluene Column Bottoms is the most preferable extraction solvent for diatomite ore among the foregoing solvents.

As shown in Table 3, the amount of oil recovered in these first 4 samples ranged from 55.0 to 82.4 weight percent of the total oil recovered by that solvent. These results are significantly different when the MCS and the core materials are considered separately. The average recovery for runs on MCS ore was 63.1%. The average for runs where core material was used, was 81.4%. Thus, partially oxidized hydrocarbons generally dissolved more slowly than un-oxidized hydrocarbons. These results indicate that it will generally be harder to recover oil from diatomite ore which has been exposed to air for a long time, such as the MCS's, than from freshly mined material, such as the cores.

EXAMPLE 2

Figure 4:
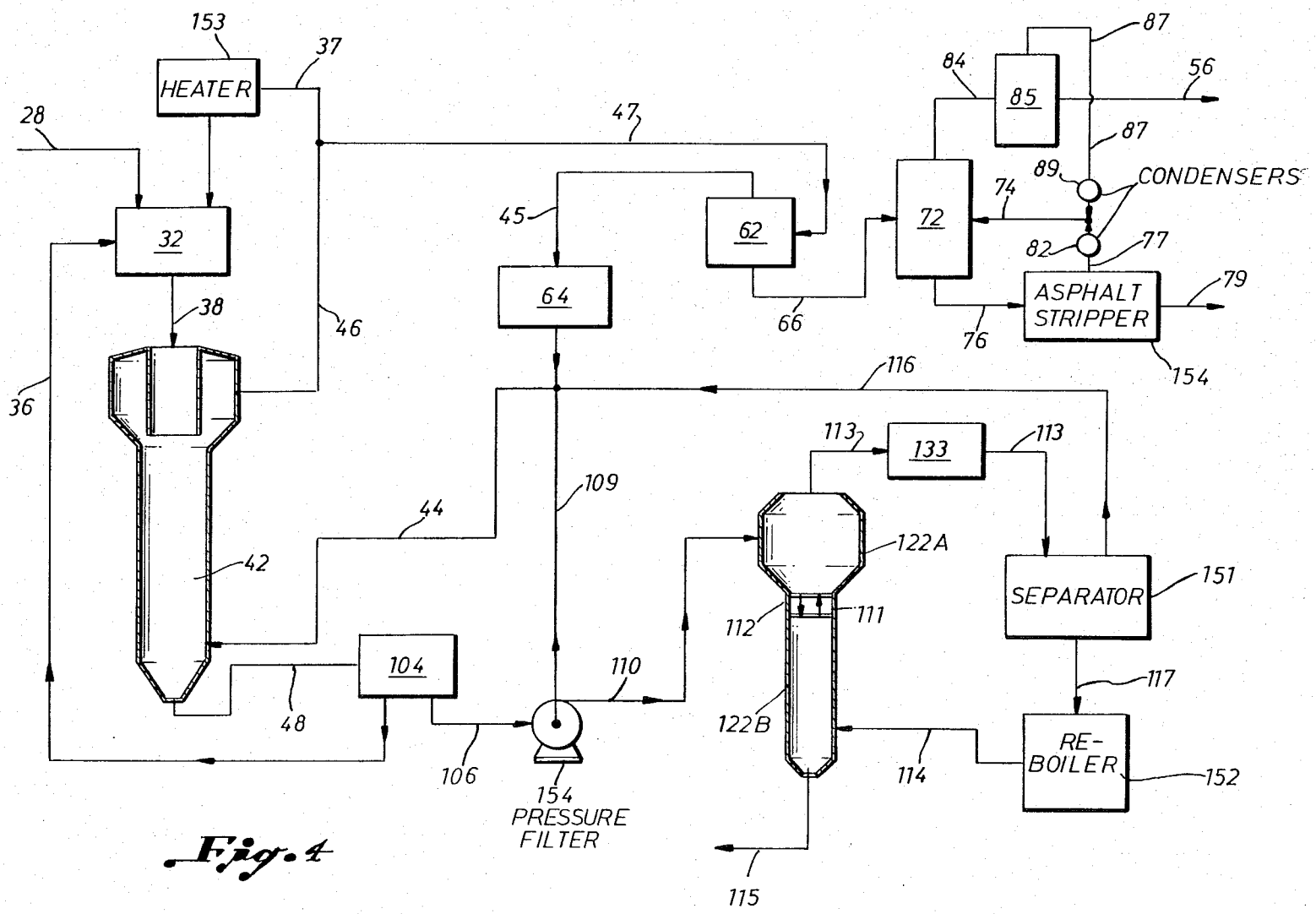
FIG. 4 is a schematic view of still another embodiment of the present invention.

The configuration shown in FIG. 4 was selected for material and heat balance calculations for a diatomite extraction process which would produce a product oil and asphalt from a diatomite ore using an aromatic solvent for the primary solvent and a paraffinic solvent for the secondary solvent. Sand would be used as a non-porous granular material.

The configuration as illustrated in FIG. 4 is generally similar to that shown in FIG. 2 with a few modifications to further illustrate the invention. For example, a pressure filter 154 is employed between a sand separator 104 and the primary solvent recovery zone. Additionally, the pneumatic dryer 122 is divided into a spent ore dryer 122A and a spent ore steam stripper 122B.

Conditions assumed in making the balances are set forth in Table 4. The mass balance for the various streams is set forth in Tables 5–15, while the heat loads are shown in Table 16 and the overall results are summarized in Table 17.

TABLE 4

CONDITIONS ASSUMED IN THE HEAT AND MASS BALANCE CALCULATIONS

1. Feed rate: 5 tons/hr of raw ore
2. Raw ore contained: 43.2 gal oil/ton (wet)
   or, the dry ore contained 57.6 gal oil/ton (dry)
   or, the diatomite contained 85.3 gal oil/ton diatomite
3. Heat capacities and heats of vaporization are presumed to be as follows:

| Component | Heat Capacity, Btu/lb °F. | Heat of Vaporization Btu/lb |
|---|---|---|
| Water | 1.00 | 948 |
| Steam | 0.36 | — |
| Solvent | 0.50 | 157 |
| Oil | 0.40 | — |
| Diatomite | 0.20 | — |
| Sand | 0.20 | — |

4. Sand recycle via line 36: 1 lb sand/1 lb diatomite
   or, 1 lb sand/1.75 lb raw ore
5. Solvent in sand: 0.2 lb solvent/lb sand
6. Recycle of rich oil-solvent in line 37: 30 wt % oil,
   or 1 lb oil/2.34 lb solvent
7. Raw oil in line 66 contains 0.5 wt % fines
8. Upgraded product oil in line 56 contains 0.05 wt % fines
9. Asphalt fuel stream in line 79 contains 2.4 wt % fines
10. Aromatic solvent loss: 0.3 wt % in product oil leaving via line 56
    100 ppm in spent ore leaving via line 115
    0.2 wt % in extracted raw oil
11. Paraffinic solvent loss: 0.2 wt % in product oil in line 56
    and, 0.1 wt % in asphalt in line 79
12. Oil rich solvent to stripper: 30 wt % raw oil in line 46
13. Solvent dissolves 92.8 wt % of oil entering in raw ore
14. Asphalt fuel heating value: 17,000 Btu/lb
15. Mixer 32 operates at 170°F.

TABLE 5

MATERIAL BALANCE AROUND MIXER (32)
All flows are in pounds per hour.

| Stream Name | Stream Number 28 Raw Ore | 36 Recycle Sand | 37 Rich Oil Solvent Recycle | 38 Hot Slurry to Extractor |
|---|---|---|---|---|
| In/Out | In | In | In | Out |
| Diatomite | 5,700 | 0 | 25 | 5,725 |
| Sand | 0 | 5,700 | 0 | 5,700 |
| Water: | | | | |
| Liquid | 2,500 | 0 | 0 | 2,500 |
| Steam | 0 | 0 | 0 | 0 |
| Hydrocarbons: | | | | |
| Oil | 1,336 | 0 | 3,928 | 5,264 |
| Asphalt | 334 | 0 | 982 | 1,316 |
| Residual | 130 | 0 | 0 | 130 |
| Aromatic Solvent: | | | | |
| Liquid | 0 | 1,140 | 11,460 | 12,600 |
| Vapor | 0 | 0 | 0 | 0 |
| Paraffinic Solvent: | | | | |
| Liquid | 0 | 0 | 0 | 0 |
| Vapor | 0 | 0 | 0 | 0 |
| | 10,000 | 6,840 | 16,395 | 33,235 |
| Temperature, °F. | 70 | 200 | 220 | 170 |

TABLE 6

MATERIAL BALANCE AROUND EXTRACTOR (42)
All flows are in pounds per hour.

| Stream Name | Stream Number 38 Hot Slurry to Extractor | 44 Aromatic Solvent | 46 Rich Oil/ Solvent | 48 Sand/Spent Ore Slurry |
|---|---|---|---|---|
| In/Out | In | In | Out | Out |
| Diatomite | 4,725 | 0 | 34 | 5,691 |
| Sand | 5,700 | 0 | 0 | 5,700 |
| Water: | | | | |
| Liquid | 2,500 | 0 | 0 | 2,500 |
| Steam | 0 | 0 | 0 | 0 |
| Hydrocarbons: | | | | |
| Oil | 5,264 | 0 | 5,264 | 0 |
| Asphalt | 1,316 | 0 | 1,316 | 0 |
| Residual | 130 | 0 | 0 | 130 |
| Aromatic Solvent: | | | | |
| Liquid | 12,600 | 14,170 | 15,370 | 11,400 |
| Vapor | 0 | 0 | 0 | 0 |
| Paraffinic Solvent: | | | | |
| Liquid | 0 | 0 | 0 | 0 |
| Vapor | 0 | 0 | 0 | 0 |
| Total Flow | 33,235 | 14,170 | 21,984 | 25,421 |
| Temperature, °F. | 170 | 230 | 170 | 200 |

TABLE 7

MATERIAL BALANCE AROUND THE SAND SEPARATOR (104)
All flows are in pounds per hour.

| Stream Name | Stream Number 48 Sand/Spent Ore Slurry | 36 Recycle Sand | 106 Spent Ore Slurry |
|---|---|---|---|
| In/Out | In | Out | Out |
| Diatomite | 5,691 | 0 | 5,691 |
| Sand | 5,700 | 5,700 | 0 |
| Water: | | | |
| Liquid | 2,500 | 0 | 2,500 |
| Steam | 0 | 0 | 0 |
| Hydrocarbons: | | | |
| Oil | 0 | 0 | 0 |
| Asphalt | 0 | 0 | 0 |
| Residual | 130 | 0 | 130 |
| Aromatic Solvent: | | | |
| Liquid | 11,400 | 1,140 | 10,260 |
| Vapor | 0 | 0 | 0 |
| Paraffinic Solvent: | | | |
| Liquid | 0 | 0 | 0 |
| Vapor | 0 | 0 | 0 |
| Total Flow | 25,421 | 6,840 | 18,581 |
| Temperature, °F. | 200 | 200 | 200 |

TABLE 8

MATERIAL BALANCE AROUND THE PRESSURE FILTER (154)
All flows are in pounds per hour.

| Stream Name | Stream Number 106 Spent Ore Ore Slurry | 109 Aromatic Solvent | 110 Spent Ore Cake |
|---|---|---|---|
| In/Out | In | Out | Out |
| Diatomite | 5,691 | 0 | 5,691 |
| Sand | 0 | 0 | 0 |
| Water: | | | |
| Liquid | 2,500 | 0 | 2,500 |
| Steam | 0 | 0 | 0 |
| Hydrocarbons: | | | |
| Oil | 0 | 0 | 0 |
| Asphalt | 0 | 0 | 0 |
| Residual | 130 | 0 | 130 |
| Aromatic Solvent: | | | |
| Liquid | 10,260 | 5,260 | 5,000 |
| Vapor | 0 | 0 | 0 |
| Paraffinic Solvent: | | | |
| Liquid | 0 | 0 | 0 |
| Vapor | 0 | 0 | 0 |
| Total Flow | 18,581 | 5,260 | 13,321 |
| Temperature, °F. | 200 | 200 | 200 |

TABLE 9

MATERIAL BALANCE AROUND SPENT ORE DRIER (122A)
All flows are in pounds per hour.

| Stream Name | Stream Number 110 Spent Ore Cake | 111 Lean Steam | 112 Drier Spent Ore | 113 Rich Vapor |
|---|---|---|---|---|
| In/Out | In | In | Out | Out |
| Diatomite | 5,691 | 0 | 5,691 | 0 |
| Sand | 0 | 0 | 0 | 0 |
| Water: | | | | |
| Liquid | 2,500 | 0 | 3,300 | 0 |
| Steam | 0 | 3,370 | 0 | 2,570 |
| Hydrocarbons: | | | | |
| Oil | 0 | 0 | 0 | 0 |
| Asphalt | 0 | 0 | 0 | 0 |
| Residual | 130 | 0 | 130 | 0 |
| Aromatic Solvent: | | | | |
| Liquid | 5,000 | 0 | 170 | 0 |
| Vapor | 0 | 170 | 0 | 5,000 |
| Paraffinic Solvent: | | | | |
| Liquid | 0 | 0 | 0 | 0 |
| Vapor | 0 | 0 | 0 | 0 |
| Total Flow | 13,321 | 3,540 | 9,291 | 7,570 |
| Temperature, °F. | 200 | 212 | 210 | 210 |

TABLE 10

MATERIAL BALANCE AROUND SPENT ORE STEAM STRIPPER (122B)
All flows are in pounds per hour.

| Stream Name | Stream Number 112 Drier Spent Ore | 114 Superheated Steam | 111 Lean Steam | 115 Spent Ore |
|---|---|---|---|---|
| In/Out | In | In | Out | Out |
| Diatomite | 5,691 | 0 | 0 | 5,691 |
| Sand | 0 | 0 | 0 | 0 |
| Water: | | | | |
| Liquid | 3,300 | 0 | | 3,300 |
| Steam | 0 | 3,370 | 3,370 | 0 |
| Hydrocarbons: | | | | |
| Oil | 0 | 0 | 0 | 0 |
| Asphalt | 0 | 0 | 0 | 0 |
| Residual | 130 | 0 | 0 | 130 |

TABLE 10-continued

MATERIAL BALANCE AROUND SPENT ORE STEAM STRIPPER (122B)
All flows are in pounds per hour.

| Stream Name | Stream Number 112 Drier Spent Ore | 114 Superheated Steam | 111 Lean Steam | 115 Spent Ore |
|---|---|---|---|---|
| Aromatic Solvent: | | | | |
| Liquid | 170 | 0 | 0 | 0 |
| Vapor | 0 | 0 | 170 | 0* |
| Paraffinic Solvent: | | | | |
| Liquid | 0 | 0 | 0 | 0 |
| Vapor | 0 | 0 | 0 | 0 |
| Total Flow | 9,291 | 3,370 | 3,540 | 9,121 |
| Temperature, °F. | 200 | 234 | 212 | 212 |

*Spent ore contains 100 ppm aromatic solvent.

TABLE 11

MATERIAL BALANCE AROUND CONDENSER-SEPARATOR (133-151)
All flows are in pounds per hour.

| Stream Name | Stream Number 113 Rich Vapor | 116 Aromatic Solvent | 117 Water |
|---|---|---|---|
| In/Out | In | Out | Out |
| Diatomite | 0 | 0 | 0 |
| Sand | 0 | 0 | 0 |
| Water: | | | |
| Liquid | 0 | 0 | 2,570 |
| Steam | 2,570 | 0 | 0 |
| Hydrocarbons: | | | |
| Oil | 0 | 0 | 0 |
| Asphalt | 0 | 0 | 0 |
| Residual | 0 | 0 | 0 |
| Aromatic Solvent: | | | |
| Liquid | 0 | 5,000 | 0 |
| Vapor | 5,000 | 0 | 0 |
| Paraffinic Solvent: | | | |
| Liquid | 0 | 0 | 0 |
| Vapor | 0 | 0 | 0 |
| Total Flow | 7,570 | 5,000 | 2,570 |
| Temperature, °F. | 210 | 187* | 187* |

*Estimated azeotropic temperature.

TABLE 12

MATERIAL BALANCE AROUND AROMATIC SOLVENT STRIPPER (62)
All flows are in pounds per hour.

| Stream Name | Stream Number 47 Rich Oil/ Aromatic Solvent | 45 Aromatic Solvent Vapor | 66 Raw Oil |
|---|---|---|---|
| In/Out | In | Out | Out |
| Diatomite | 9 | 0 | 9 |
| Sand | 0 | 0 | 0 |
| Water: | | | |
| Liquid | 0 | 0 | 0 |
| Steam | 0 | 0 | 0 |
| Hydrocarbons: | | | |
| Oil | 1,336 | 0 | 1,336 |
| Asphalt | 334 | 0 | 334 |
| Residual | 0 | 0 | 0 |
| Aromatic Solvent: | | | |
| Liquid | 3,910 | 0 | 4 |
| Vapor | 0 | 3,906 | 0 |
| Paraffinic Solvent: | | | |
| Liquid | 0 | 0 | 0 |
| Vapor | 0 | 0 | 0 |
| Total Flow | 5,589 | 3,906 | 1,679 |

TABLE 12-continued

MATERIAL BALANCE AROUND AROMATIC SOLVENT STRIPPER (62)
All flows are in pounds per hour.

| Stream Name | Stream Number 47 Rich Oil/ Aromatic Solvent | 45 Aromatic Solvent Vapor | 66 Raw Oil |
|---|---|---|---|
| Temperature, °F. | 170 | 230 | 250 |

TABLE 13

MATERIAL BALANCE AROUND DE-ASPHALTER (72)
All flows are in pounds per hour.

| Stream Name | Stream Number 66 Raw Oil | 74 Paraffinic Solvent | 84 Product Oil/ Solvent | 76 Asphalt/ Solvent |
|---|---|---|---|---|
| In/Out | In | In | Out | Out |
| Diatomite | 9 | 0 | 0* | 9 |
| Sand | 0 | 0 | 0 | 0 |
| Water: | | | | |
| Liquid | 0 | 0 | 0 | 0 |
| Steam | 0 | 0 | 0 | 0 |
| Hydrocarbons: | | | | |
| Oil | 1,336 | 0 | 1,336 | 0 |
| Asphalt | 334 | 0 | 0 | 334 |
| Residual | 0 | 0 | 0 | 0 |
| Aromatic Solvent: | | | | |
| Liquid | 4 | 0 | 4 | 0 |
| Vapor | 0 | 0 | 0 | 0 |
| Paraffinic Solvent: | | | | |
| Liquid | 0 | 8,350 | 8,000 | 350 |
| Vapor | 0 | 0 | 0 | 0 |
| Total Flow | 1,679 | 8,350 | 9,336 | 684 |
| Temperature, °F. | 250 | 250 | 250 | 250 |

TABLE 14

MATERIAL BALANCE AROUND ASPHALT STRIPPER (152)
All flows are in pounds per hour.

| Stream Name | Stream Number 76 Asphalt/ Solvent | 77 Paraffinic Solvent Vapor | 79 Asphalt Fuel |
|---|---|---|---|
| In/Out | In | Out | Out |
| Diatomite | 9 | 0 | 9 |
| Sand | 0 | 0 | 0 |
| Water: | | | |
| Liquid | 0 | 0 | 0 |
| Steam | 0 | 0 | 0 |
| Hydrocarbons: | | | |
| Oil | 0 | 0 | 0 |
| Asphalt | 334 | 0 | 334 |
| Residual | 0 | 0 | 0 |
| Aromatic Solvent: | | | |
| Liquid | 0 | 0 | 0 |
| Vapor | 0 | 0 | 0 |
| Paraffinic Solvent: | | | |
| Liquid | 350 | 0 | 0* |
| Vapor | 0 | 350 | 0 |
| Total Flow | 693 | 350 | 343 |
| Temperature, °F. | 250 | 150 | 200 |

*Less than 0.1 wt % paraffinic solvent in asphalt.

TABLE 15

MATERIAL BALANCE AROUND PRODUCT OIL STRIPPER (85)
All flows are in pounds per hour.

| Stream Name | Stream Number 84 Product Oil/ Solvent | 87 Paraffinic Solvent Vapor | 56 Product Oil |
|---|---|---|---|
| In/Out | In | Out | Out |
| Diatomite | 0 | 0 | 0* |
| Sand | 0 | 0 | 0 |
| Water: | | | |
| Liquid | 0 | 0 | 0 |
| Steam | 0 | 0 | 0 |
| Hydrocarbons: | | | |
| Oil | 1,336 | 0 | 1,336 |
| Asphalt | 0 | 0 | 0 |
| Residual | 0 | 0 | 0 |
| Aromatic Solvent: | | | |
| Liquid | 4 | 0 | 4 |
| Vapor | 0 | 0 | 0 |
| Paraffinic Solvent: | | | |
| Liquid | 8,000 | 0 | 3 |
| Vapor | 0 | 7,997 | 0 |
| Total Flow | 9,340 | 7,997 | 1,343 |
| Temperature, °F. | 250 | 150 | 200 |

*Product oil contains 100 ppm diatomite.

TABLE 16

HEAT LOADS ON PROCESS EQUIPMENT

| | Temperature °F. In | Out | Heat Load, Btu/hr Heating | Cooling |
|---|---|---|---|---|
| Recycle Heater (153) | 170 | 220 | 385,000 | — |
| Aromatic Solvent/ Raw Oil Stripper (62) | 170 | 220 | 341,000 | — |
| Reboiler (152) | 180 | 234 | 3,195,000 | — |
| Aromatic Solvent Condenser (64) | 240 | 230 | — | 263,000 |
| Aromatic Solvent/ Steam Condenser (133) | 210 | 180 | — | 3,224,000 |
| Oil-Flashed Paraffinic Solvent Condenser (89) | 250 | 200 | — | 320,000 |
| Asphalt-Flashed Paraffinic Solvent Condenser (82) | 250 | 200 | — | 14,000 |
| Total Heat In, Btu/hr: | | | 3,921,000 | |
| Total Cooling Out Btu/hr: | | | | 3,821,000 |
| With 10% for heat losses: | | | 4,313,000 | |

TABLE 17

SUMMARY OF PROCESS FLOWS AND HEAT LOADS

| Material | Flow, in pounds per hour Raw Ore | Spent Ore | Oil Product | Asphalt Product |
|---|---|---|---|---|
| Diatomite | 5,700 | 5,690.9 | 0.1 | 9.0 |
| Water | 2,500 | 3,300.0 | 0 | 0 |
| Hydrocarbon | 1,800 | 130.0 | 1,336.0 | 334.0 |
| Solvent | 0 | 0.6 | 7.0 | 0.3 |
| Total | 10,000 | 9,121.5 | 1,343.1 | 343.3 |

Water required: 800 lb/hr
Aromatic solvent loss: 4.6 lb/hr
Paraffinic (deasphalting) solvent loss: 3.3 lb/hr
Process heat required: 4,313,000 btu/hr
Asphalt fuel, @ 17,000 btu/lb: 254 lb/hr

| Net Product | Bbls/hr | °API |
|---|---|---|
| Oil | 3.82 | 15 |
| Asphalt | 0.23 | 6 |

It is calculated that approximately 75% of the hydrocarbons in the raw diatomite ore would be recovered as an oil product with about another 19% being recovered in the form of asphalt. Prior processes will generally recover about 70% of the hydrocarbons present in the diatomite. Presuming that about 15% of the hydrocarbons recovered in prior processes are used in meeting process heat loads, this results in the production of about 1070 pounds of oil per 5,700 pounds of raw ore or 3.06 bbls/hour for a typical prior process. Based on the foregoing calculations the present process compares favorably, producing about 1343 pounds of oil per 5,700 pounds of raw ore or 3.82 bbls/hour. Additionally, as shown in Table 17 since only 254 pounds per hour of asphalt are required to meet process energy needs, additonal asphalt is available for other uses.

Although the foregoing examples as well as a large part of the foregoing discussion have been mainly directed to the use of the invention in connection with the extraction of an oil bearing diatomaceous earth or diatomite ore, it should be understood that the invention can also be used to advantage in conjunction with the extraction of hydrocarbons from a variety of hydrocarbon containing ores, such as bitumens, resins of fossil origin, oil shale, tar sands, natural asphalts and the like.

Further modifications and alternative embodiments of the inventive method and apparatus will be apparent to those skilled in the art having the benefit of this disclosure. Accordingly, this description and the examples are to be construed as illustrative only and for the purpose of teaching those skilled in the art the manner of carrying out the invention according to the patent statutes. For example, equivalent materials may be substituted for those specifically illustrated and described herein and certain features of the invention may be utilized independently of the use of other features. All this would be apparent to one skilled in the art after having the benefit of this description of the invention.

What is claimed is:

1. A hydrocarbon extraction process for removing hydrocarbons from a hydrocarbon containing ore, comprising:

processing the ore to the extent required to form an extractable ore, said processing step comprising drying the ore to remove water in the ore and reducing the size of the ore;

mixing the extractable ore and a carrier to form a flowable ore stream, the carrier comprising a granular material having a low affinity for hydrocarbons and being of sufficient size to increase the permeability of the flowable ore stream to a nonaqueous extracting solvent when in the presence of any fines, while reducing the ability of the flowable ore stream to be fluidized;

thereafter passing the nonaqueous extracting solvent in substantially vertical countercurrent flow and at a sufficient velocity relative to the ore stream to contact the nonaqueous solvent with the ore stream without substantially fluidizing the ore stream and form a product-solvent stream comprising hydrocarbons and solvent and a spent ore stream comprising spent ore and solvent; and separating solvent from the product-solvent stream to produce a hydrocarbon stream.

2. A process according to claim 1 further comprising the step of separating a heavy portion from the hydrocarbon stream to form an upgraded hydrocarbon stream.

3. A process according to claim 2 wherein the step of separating a heavy portion from the hydrocarbon stream comprises the step of mixing the hydrocarbon stream with an upgrading solvent in the presence of fines to form a solvent-upgraded hydrocarbon stream and a heavy stream comprising substantially all of the fines and the heavy portion from the hydrocarbon stream.

4. A process according to claim 3 wherein the upgrading solvent is separated from the solvent-upgraded hydrocarbon stream to form an upgraded hydrocarbon stream.

5. A process according to claim 3 wherein the upgrading solvent comprises a paraffinic hydrocarbon.

6. A process according to claim 5 wherein the paraffinic hydrocarbon comprises a paraffinic hydrocarbon having from 3 to 7 carbons.

7. A process according to claim 2 wherein the step of separating the heavy portion comprises the step of cooling the hydrocarbon stream sufficiently to separate out the heavy portion.

8. A process according to claim 1 further comprising the step of nonaqueous separation of the solvent from the spent ore stream.

9. A process according to claim 8 wherein the nonaqueous separation of the solvent comprises the evaporation of the solvent from the spent ore.

10. A process according to claim 1 wherein the solvent comprises at least a substantial aromatic portion.

11. A process according to claim 1 wherein the carrier further comprises a nonaqueous solvent.

12. A processes according to claim 1 wherein the carrier comprises a non-oil bearing, non-porous granular material.

13. A process according to claim 12 wherein the nonporous granular material is non-oil bearing sand.

14. A process according to claim 1 wherein the carrier comprises a portion of the product-solvent stream.

15. A process according to claim 1 wherein the extractable ore comprises fines and further comprising the step of reducing the flow rate of the product-solvent stream prior to separating solvent by changing the cross-sectional flow volume of the product-solvent stream.

16. A hydrocarbon extraction process for removing hydrocarbons from a hydrocarbon containing ore comprising the steps of:

crushing and drying a hydrocarbon containing ore comprising diatomite ore to remove water from the ore and produce an extractable ore comprising a portion of fines;

mixing the extractable ore with a carrier comprising an aromatic solvent and a granular material of sufficient size to increase the permeability of the diatomite ore to the solvent to form a flowable ore stream;

passing a nonaqueous solvent comprising additional aromatic solvent in substantially vertical countercurrent flow through the ore stream to contact the aromatic solvent with the ore in the ore stream and form a product-solvent stream comprising hydrocarbons, solvent and a portion of fines and a spent ore stream comprising spent ore, solvent and any remaining fines;

reducing the flow rate of the product-solvent stream by changing the cross-sectional flow volume of the product-solvent stream to reduce the portion of any fines in the product-solvent stream to facilitate separation of the nonaqueous solvent from the product-solvent stream while leaving sufficient fines to facilitate formation of a solvent upgraded hydrocarbon stream;

recycling a portion of the product-solvent stream to mix with the extractable ore in forming the flowable ore stream;

separating nonaqueous solvent comprising an aromatic solvent from the product-solvent stream to produce a hydrocarbon stream;

mixing the hydrocarbon stream with a paraffinic solvent in the presence of fines to produce a solvent upgraded hydrocarbon stream and a heavy stream comprising asphalt and substantially all of the fines; and recovering the nonaqueous solvent comprising an aromatic solvent from the spent ore stream.

* * * * *